United States Patent [19]

Foose

[11] Patent Number: 4,567,661

[45] Date of Patent: Feb. 4, 1986

[54] SMOCKING BOARD

[76] Inventor: Cynthia V. Foose, 2147 Southwood Rd., Jackson, Miss. 39211

[21] Appl. No.: 706,837

[22] Filed: Feb. 28, 1985

[51] Int. Cl.[4] ..... A41H 1/00

[52] U.S. Cl. ..... 33/11; 33/17 R

[58] Field of Search ..... 33/11, 2 R, 12, 1 AA, 33/17 R, 17 A

[56] References Cited

U.S. PATENT DOCUMENTS

| | | | |
|---|---|---|---|
| 154,694 | 9/1874 | Martin | 269/54.5 |
| 215,423 | 3/1879 | Winans | 223/33 |
| 309,754 | 4/1884 | Weller | 223/33 |
| 629,255 | 4/1899 | Hurlbut | 223/33 |
| 647,836 | 4/1900 | Hurlbut | 223/33 |
| 1,377,631 | 5/1915 | Sadtler | 2/244 |
| 1,410,653 | 3/1921 | Clark et al. | 223/33 |
| 1,799,575 | 4/1931 | Wendt | 223/33 |
| 1,806,887 | 9/1930 | Bruno | 269/54.5 |
| 2,068,684 | 1/1937 | Kravitz | 33/12 |
| 2,157,573 | 5/1939 | Sadtler | 2/244 |
| 2,195,985 | 3/1939 | Fox | 40/611 |
| 2,425,247 | 5/1945 | Kelly | 223/28 |
| 2,437,084 | 7/1946 | Esecson | 38/12 |
| 3,216,024 | 11/1965 | Menhart | 2/274 |
| 3,633,800 | 1/1972 | Wallace | 223/28 |
| 3,755,053 | 8/1973 | Lindahl | 428/81 |
| 4,053,986 | 10/1977 | Axlerod | 33/12 |
| 4,133,123 | 1/1979 | Anderson | 40/1 |
| 4,364,494 | 12/1982 | Shive | 223/28 |

FOREIGN PATENT DOCUMENTS

| | | | |
|---|---|---|---|
| 303150 | 1/1955 | Switzerland | 33/12 |
| 2018127 | 10/1979 | United Kingdom | 33/17 R |

*Primary Examiner*—Willis Little

*Attorney, Agent, or Firm*—Oblon, Fisher, Spivak, McClelland & Maier

[57] ABSTRACT

A device to improve and simplify techniques in needlework construction is disclosed which utilizes a porous resilient surface and a dense backing structure. The resilient surface is divided into two equal main working areas by a main indicator and each of the two main working areas are divided into smaller working areas by a plurality of secondary indicators. The purpose of the main and secondary indicators is to provide proper alignment of clothing materials placed on the device and more particularly with respect to completing a smocking apparatus. The purpose of the alignment indicators is to provide a series of work areas whereby a pre-pleated material can be pinned and retained while the smocking stitching is accomplished. The device also includes a circular marking area at the center of the structure which consists of a series of concentric circular lines having circumferences corresponding to standard neck sizing which is used for proper location of materials to be accomplished with smocking of round yoke or bishop dresses or collars.

10 Claims, 2 Drawing Figures

SMOCKING BOARD

BACKGROUND OF THE INVENTION

The present invention is related to the field of clothing construction and particularly to the sewing technique known as smocking. More particularly, the invention relates to a device to assist an individual in creating uniform smocked design.

Smocking is a popular needleart construction technique which utilizes decoratively stitched together fabric folds in order to create a pattern. In a typical operation, a pre-pleated or gathered section is prepared before the smocking operation is performed. Smocking is often used on yokes, bodices, pockets, sleeves and waist lines in order to create a garment which has a decorative effect. The folds or pleats which are used in the smocking operation can also be accomplished when the actual smocking stitching is done which is known as the American smocking technique. The technique in which the fabric is first gathered into folds and then smocked is known as English smocking. Because of the advent of machines and because of the ease of preparation the English smocking has become prevalent whereby the machine or the individual gathers the folds or pleats prior to the actual smocking operation.

Once the pleats have been "gathered" and the material is ready for the smocking operation, there commonly exists a problem with respect to the fitting or sizing of the pre-pleated material onto the yoke. Not only must the size of the material which has been gathered be an exact fit onto the yoke but the pleats themselves must be kept straight in each of the rows of the smocking material. Although it has been commonly the practice to pin these materials to a more rigid backing material such as heavy weight paper, the actual construction of the sewing technique with respect to the smocking operation has been difficult because of problems with respect to holding the material properly in place in a rigid manner while at the same time exactly locating the center of the material for purposes of creating the ornamental design which is to be smocked. The most common method of English smocking is to hold the pre-pleated material in one hand and stitch with the other hand. As the stitching is completed the completed stitched material is scrolled and collected in the one hand (usually the left hand) while the other hand continues stitching a few inches at a time. Upon completion of the stitching of a particular row the left hand, for example, would contain the rolled material. Utilizing this method only a few pleats are visible at one time which exemplifies one of the problem areas in the prior art methods. Other problem areas with respect to these methods include the maintaining of uniform size, shape and tension of the overall piece. These problems with respect to the size, shape and tension ultimately lead to a difficulty in obtaining symmetry with respect to the final product.

The holding and proper spacing of a smocking material cannot be suitably solved by a stationary, free-standing or large sizing structure because such a structure would not permit the individual sewing the material to be positioned comfortably for the exacting nature of the work which is required to complete the decorative sewing together of the folds or pleats. This especially applies to what is known as picture smocking or stacked cables which is the creation of one or more shapes of a design which depicts object(s) rather than a geometric pattern. For example, in the design of a row of ducks, uniform size, shape and spacing of each of the ducks is critical.

There is also a problem with respect to using English smocking to create round yoke (bishop) dresses or collars which utilize smocking on the material of the dress itself and which involves the arrangement of the pre-pleated upper portion of the dress or collar in such a manner that the secured pleats must extend in a "spoke" (circular) fashion from the neck edge. It is quite obvious that the problems with respect to holding the material properly as well as providing for a convenient and comfortable sewing position exists in this area in a manner similar to the above described English smocking operations. Other areas whereby material must be held in a temporary manner in order to provide the final operation include the sewing of a lace work project which must involve presewing or basting in order to provide a secure position for the material which is to be fashioned together. Likewise the sewing technique known as fagoting which involves decorative stitching used to join two fabric sections while leaving a space in between those sections, requires that the fabric edges must be folded back and pinned and basted along each edge which is normally accomplished by the use of paper on which parallel lines are drawn.

Prior art attempts at providing solution to these problems involve complicated structures which are only utilized in mass production operations or they involve techniques and apparatus which do not provide for satisfactory results especially when an individual operator must perform the sewing work.

SUMMARY OF THE INVENTION

The present invention provides a device to improve and simplify techniques utilized in fine needle work such as smocking, lace work, fagoting and blocking for construction. The device provides a unique tool which utilizes a rigid rectangular work surface divided into a plurality of evenly spaced work surface areas with the work surface areas being symmetrically located on either side of a centering structure as delimited by a centering line which is equidistant spaced between the lengthwise ends of the device and which extends perpendicular to the length of the device across the entire width of the device. Each of the symmetrically and evenly spaced work areas are defined by rectangular areas having a width which is equal to a unit of close measurement sizing.

It is another object of the present invention to provide a device which is specifically adapted for round yoke (bishop) dresses or collars which utilizes a series of circularly defined work areas centered on the device in such a manner that a plurality of work areas are defined in a series of increasing concentric circles with the circumference of each circle defining a unit of standard neck size measurement.

It is also an object of the present invention to provide a device provided with a work surface which is readily penetratable by ordinary ball-headed pins and which is able to be sufficiently weighted to provide a stable working structure which can be held and workably controlled by an individual on his or her lap. The sizing of the outside diameters of the device have been designed so as to provide sufficient surface area for the largest commonly used construction pattern and yet not exceed a size which can be workably used by an individual when held in his or her lap.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
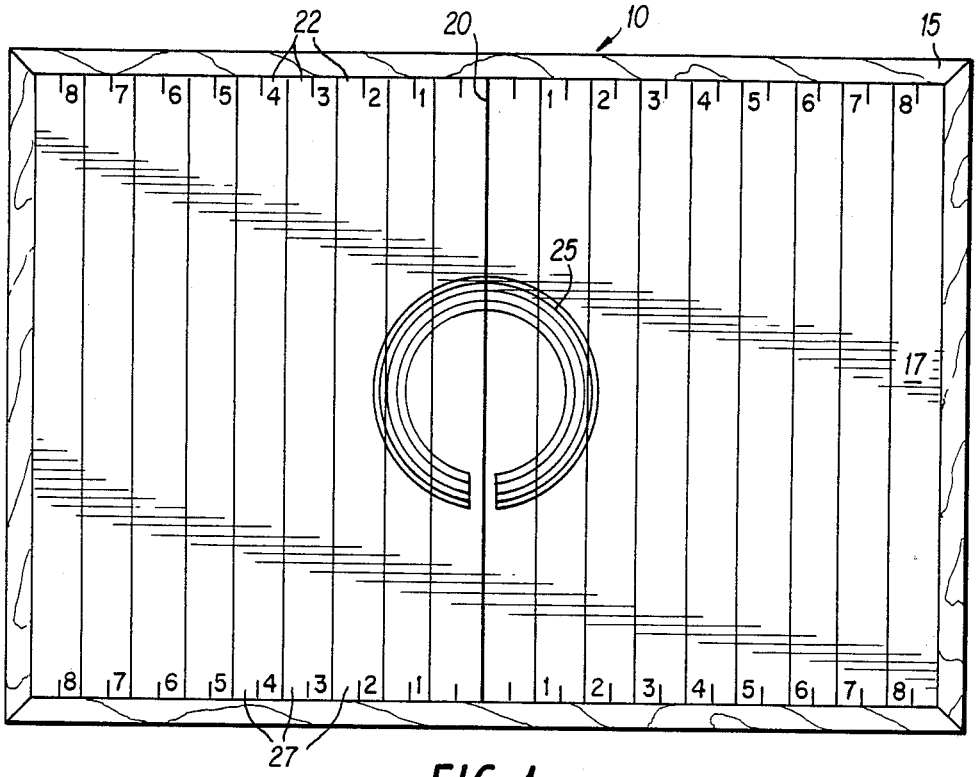
FIG. 1 shows a top view of the various constructural work areas on the surface of the smocking board.

Referring now to the drawings, wherein like reference numerals designate identical or corresponding parts, and more particularly to FIG. 1 thereof, there is shown a smocking board 10 of the present invention having a wood frame 15 surrounding the cork surface 17. The cork surface 17 has been divided in half by a center registration line 22 which bisects the length of the board 10 along its entire width. On either side of the primary registration marked 20 is a plurality of registration demarcations 22 which define work areas in such a manner that each of these denoted work areas are numbered in consecutive order beginning from the center registration marked 22.

Each of these work areas 22 and the center registration mark 20 can for example be defined by a series of lines or small grooves which extend the entire width of the board 10. The use of grooves or slight indentations provides an aid to an operator to know their location with respect to a smocking material which covers portions of the board. That is, for example, having a slight depression in the structure or any other type of feature to denote these lines, which has a effect on the "feel" of the surface, indicates the location of these lines which define these work areas 22 in such a way that they could be felt through the smocking cloth without the need for visually observing the lines by unpinning the cloth and searching for them underneath the cloth which would be an inconvenience and would also cause possible movement of the material when the cloth is repinned. This is particularly relevant to English smocking where a machine has advance gathered the folds or pre-pleated the folds and when the material is stretched out and pinned on the smocking board. Each of the pleats from consecutive rows need to be properly aligned which could be aided by use of the "feel" which the operator can obtain by simply pressing a finger on the material to locate the particular boundaries of the work areas 22. This would eliminate the use of a straight edge on the top of the material to correctly align the pleating.

Each of the lines for the work areas 22 are separated by a unit of clothing measurement which in the English system would be 1 inch and in the instance of metric system could be an appropriate marking in centimeters. Located at the ½ inch intervals between each of the lines or a plurality of markings 27 at both the top and the bottom of the board in order to act as a further aid in aligning or properly registering a material on the board.

Concentric with the center of the board is a plurality or circular demarcations 25 with each demarcation having a circumference corresponding to a neck size. The registration mark 22 bisects each of the circles and the lower portion of each of these circles is discontinuous and separated by a space equal to ½ inch in the instance of the English system which corresponds to a seam allowance provided as a further aid to constructural techniques in this area of clothing construction. The letters CB denote "center back" and the letters CF denote center front as a further remainder and aid in the positioning of a collar or round yoke or bishop dress.

Figure 2:
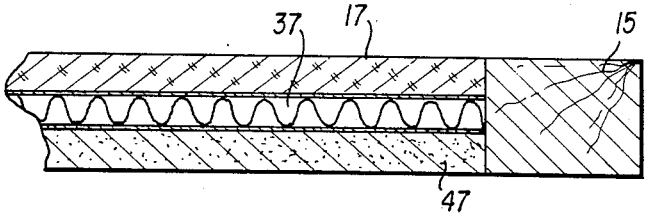
FIG. 2 shows a cut away section of the smocking board of FIG. 1 showing constructural details with respect to the materials utilized.

The construction of the board itself with respect to materials is shown in the FIG. 2 wherein 17 denotes a cork work surface which is typically a ¼ inch placed on a 5/32 inch corrugated paper board 37. In order to provide the required rigidity and a sufficient weight to provide stability the paper board 37 and the cork surface 17 are supported by a ½ inch Masonite backing structure 47. The wood frame 15 surrounds the entire structure. The spacing with respect to the dimensions of the cork work surface 37 and the corrugated paper board 17 have been selected such that standard ball-headed pins with ⅝ inch slender shaft may be used. When inserted into the board, the head of each pin remains in the valley between and below the peaks of the pleats.

The overall dimensions of the board have been selected through a trial and error method as being 17 inches long and 13 inches wide. The largest yoke measurment normally used throughout the standardized industry of clothing construction is 16 inches which provides, allowing a ½ inch on each side, for the length of 17 inches. The width and the length have also been selected to accommodate 12 rows of smocking which is normally the largest number used in the construction of round yoke or bishop dresses. The length and width have also been selected so as not to exceed the dimensions of 13 by 17 in order to provide a compact and usable work surface which is able to be placed upon the workers lap or conveniently placed on a table or otherwise held so that the minute details of the decorative smocking stitches can be comfortably and conveniently made.

The operation of specific sewing techniques will now be described with respect to the use of the smocking board of the figures.

The use of the smocking board to accomplish English smocking begins with a fabric which has been pre-pleated either by hand or by a pleating machine. This pre-pleated fabric already has pleats which are gathered in such a manner that the various rows of pleats or folds have been gathered together and are ready for a smocking operation. After the gathering rows are pulled out for seam allowances on either side of the pleated piece, the pleated piece is secured to the board using small, ball-headed pins. The vertical lines which divide up the various work areas 22 serve to align the piece so that it will conform to pattern size and shape. Once the material is secured, the pleats remain straight and evenly distributed. The securing, for example, can be by pins at each end of the fabric and centering pins along the registering demarcation 22. Because of the even distribution and the straight pleats which can be formed, this secured fabric can then allow for stitching tension and control to be maintained as the pieces is smocked. This is especially important to "picture smocking" or "stacked cables" which requires care to obtain straight pleats to provide an overall consistency so that the "picture" which is smocked remains a true and faithful reproduction both during and after the smocking operation and the final blocking.

With respect to the use of the board for round yoke or bishop dresses or collars, the circles in the center of the board are used as guidelines for neck measurements for the round yoke dresses or collars. The board also provides a base for securing the pleats in a round yoke dress in a "spoke" fashion with the gathering rows increasing concentrically away from the neck edge. For example, row 1 would be smaller in diameter than row 2 and row 2 smaller than row 3. The pleats remain uniformly aligned as the diameter of the gathering rows increases. This eliminates "turtlenecking," and insures proper fit of the finished garment across the neck and shoulders once the smocking is completed. Utilizing this type of structure for the round yoke dresses also provides a proper base whereby ribbon can be integrated into the smocked design while the pleats are attached to the board.

The board can also be used for simplifying projects involving lace work whereby the designing of the elements of a lace work project to be stitched can be more simply accomplished by pinning the insertions, headings and edgings to the board. The stitching of the pieces can be done with the board as a work surface and the circles as neck sizing guides.

Another operation which involves a decorative stitch is called "fagoting" which is used to join two fabric sections leaving a space in between. Fagoting is used in such areas as yoke sections or bands near the bottom of the skirt. The fabric edges must be folded back accurately so as to maintain the position of the original seam line which, after fagoting should be at the center of a space between folded edges. While previously this decorative stitching was accomplished by utilizing a piece of paper on which parallel lines were drawn to represent the width of the open between folded back fabric and edges, this involved using a separate piece of paper as well as a separate basting of the fabric to the paper along the parallel lines. With the present invention, the pattern and the fabric pieces may be pinned to the board to eliminate this tedious basting with the board holding the pieces in position as the fagoting stitches are made.

The smocking board of the FIGS. 1 and 2 may be used to provide a base surface for sizing and pinning the pieces prior to the steaming operation during blocking. It should also be noted that utilizing the device during the smocking operations results in a finished product of predetermined size and shape and which does not need careful and extended blocking operations for construction completion. This occurs because the pleats have retained their proper size and the tension and control has been maintained during the entire smocking operation.

The smocking board of FIGS. 1 and 2 provides a concept for smocking which is itself new and unique and which solves the problems of the prior art with respect to eliminating the need for heavy paper, roll towels or pillows to help control the pleated piece while the smocking stitches are accomplished. Smocking on this particular board frees one hand of the user to facilitate the creation of the smock design. The shape and the weight of the board have been calculated to give maximum stability and maneuverability.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for use as an aid in clothing construction, comprising:

a planar member including a porous resilient member forming an upper surface of said planar member for releasably retaining a plurality of pins and a backing structure made of a dense material to provide rigidity to said planar member wherein said porous member is positioned and retained on said backing structure;

main registering means formed on said resilient member and bisecting the area of said planar member;

a plurality of secondary registration means each formed on said resilient member parallel to said main registration means wherein the distance between adjacent ones of said plurality of registration means is a predetermined constant and wherein one of said secondary registration means is positioned on each side of said main registration means at said predetermined constant distance; and a plurality of circular concentric registration means formed on said resilient member with the center of each of said plurality of circular concentric registration means coinciding with the geometric center of said planar member and wherein the circumference of each of said circular registration means corresponds to a standard neck sizing unit.

2. The apparatus according to claim 1 wherein said planar member is rectangular and wherein said main registration means divides said rectangular planar member into two rectangular planar members.

3. Apparatus according to claim 2 wherein said planar member further includes a frame means for positioning and retaining said porous resilient member on said backing structure.

4. The apparatus according to claim 1 wherein said porous resilient member includes a cork board work surface retained on a corrugated paper board member.

5. The apparatus according to claim 1 wherein the difference in circumference between adjacent ones of said circular concentric registration means is constant.

6. The apparatus according to claim 1 wherein said main registration means and said plurality of secondary registration means provides both visual and tactile indications of positional relationships of clothing materials placed on said planar member.

7. Apparatus according to claim 1 wherein said backing structure comprises Masonite.

8. Apparatus according to claim 2 wherein the width of said rectangular planar member is 13 inches and the length of said planar member is 17 inches.

9. Apparatus according to claim 1 further including a plurality of indicia formed on said resilient member with each of said indicia being associated with one of said secondary registration means.

10. Apparatus according to claim 9 wherein said indicia is symmetrical with respect to said main registration means.

* * * * *